US007762828B2

(12) United States Patent
Yeh et al.

(10) Patent No.: US 7,762,828 B2
(45) Date of Patent: Jul. 27, 2010

(54) ELECTRICAL CONNECTOR WITH SLIDING CONNECTION

(75) Inventors: Chen-Kuang Yeh, Taipei (TW); Tsung-Chin Wang, Taipei (TW)

(73) Assignee: Premier Image Technology Corporation, Taipei (TW)

( * ) Notice: Subject to any disclaimer, the term of this patent is extended or adjusted under 35 U.S.C. 154(b) by 0 days.

(21) Appl. No.: 11/008,920

(22) Filed: Dec. 13, 2004

(65) Prior Publication Data

US 2006/0128188 A1 Jun. 15, 2006

(51) Int. Cl.
*H01R 13/625* (2006.01)
*H01R 4/50* (2006.01)

(52) U.S. Cl. ..... 439/342

(58) Field of Classification Search ..... 439/342, 439/376, 929, 332–334, 347, 953, 607, 901, 439/372, 364

See application file for complete search history.

(56) References Cited

FOREIGN PATENT DOCUMENTS

WO WO 03/088423 * 10/2003

* cited by examiner

*Primary Examiner*—Javaid H. Nasri
(74) *Attorney, Agent, or Firm*—Rosenberg, Klein & Lee

(57) ABSTRACT

An electrical connector with sliding connection has a main body and a mated device, which both can electrically and mechanically connect together. The main body has a concave room. The concave room has an electrical connector that can slide back and forth by elasticity and outer forces. The mated device has a mated connector compared to the electrical connector. When connecting the electrical connector with the sliding connection, the present invention can transversely connect the electrical connector and the mated connector, and then by vertically sliding clamp the main body and the mated device. The electrical connector will follow the sliding motion.

10 Claims, 6 Drawing Sheets

ELECTRICAL CONNECTOR WITH SLIDING CONNECTION

BACKGROUND OF THE INVENTION

1. Field of the Invention

The present invention relates to an electrical trolley connector, and especially to an electrical connecting device using an elastic sliding connection to connect a main body and a mated device electrically and mechanically.

2. Description of Prior Art

The promotion of electrical products makes the data transfer quantities much higher than before. To expand the function, two electrical products connect to each other through an electrical connection device. The electrical connection device includes an electrical connector and a mated connector. Due to the large data transfer quantity, the signal wires are also increased and cannot connect in a sliding manner. The most common method is to combine the electrical connector and the mated connector, and then latch two electrical products together by a latching mechanism.

For example, the two electrical products can be a media display with an electrical connector and an application module with a mated connector. The application module can be a digital camera, an antenna module or a media display module. After the application modules in first application method are connected to the video display, the media display can be a view finder or a screen used to browse photos. In second application method, the media display is a portable television that can receive signals through an antenna thereof. In the third application, users can display music or entertainment films.

SUMMARY OF THE INVENTION

The object of the present invention of the electrical connector with sliding connection is to make an electrical connector on a main body that has sliding function, and fasten thereof a mated connector in a mated device to connect efficiently and electrically the electrical connector and the mated connector. Therefore, the main body and the mated device can be fastened together in a sliding motion. During the sliding motion, the electrical connector still remains in an electric contact position by elastic sliding. Moreover, a rotational device is set up on the mated device to fasten an electrical manufacture on the other side of the rotational device.

Even if the connector has many signal wires, two electrical products still can combine together by "sliding and clamping". Users can easily and quickly take apart or combine two electrical products. The present invention also has a rotational function.

To achieve the objects mentioned above, the present invention provides an electrical connector with sliding connection, including a main body and a mated device. The mated device has a mated connector and a mated shell with a plurality of vice-fasteners. The main body comprises a connection shell which forms a concave room 11 at the inner side of the connection shell. The concave room has a plurality of main fasteners matching the vice-fasteners, the connection shell has an opening between the inner side and an outer side, and the mated shell first connects the concave room and then clamps the main fasteners and the vice-fasteners by a sliding motion. A seat connects to the outer side of the connection shell, a first and a second elastic unit are set between the seat and the connection shell in the sliding direction, and the seat can slide on the outer side of the connection shell.

The electrical connector with sliding connection further comprises a PCB, part of which also comprises an electrical connector. The PCB is set on the seat and the electrical connector plug into the concave room through the opening of the connection shell. The electrical connector is shorter than the opening.

BRIEF DESCRIPTION OF THE DRAWINGS

The features of the invention believed to be novel are set forth with particularity in the appended claims. The invention itself, however, may be best understood by reference to the following detailed description of the invention, which describes certain exemplary embodiments of the invention, taken in conjunction with the accompanying drawings, in which:

DETAILED DESCRIPTION OF THE INVENTION

Figure 1:
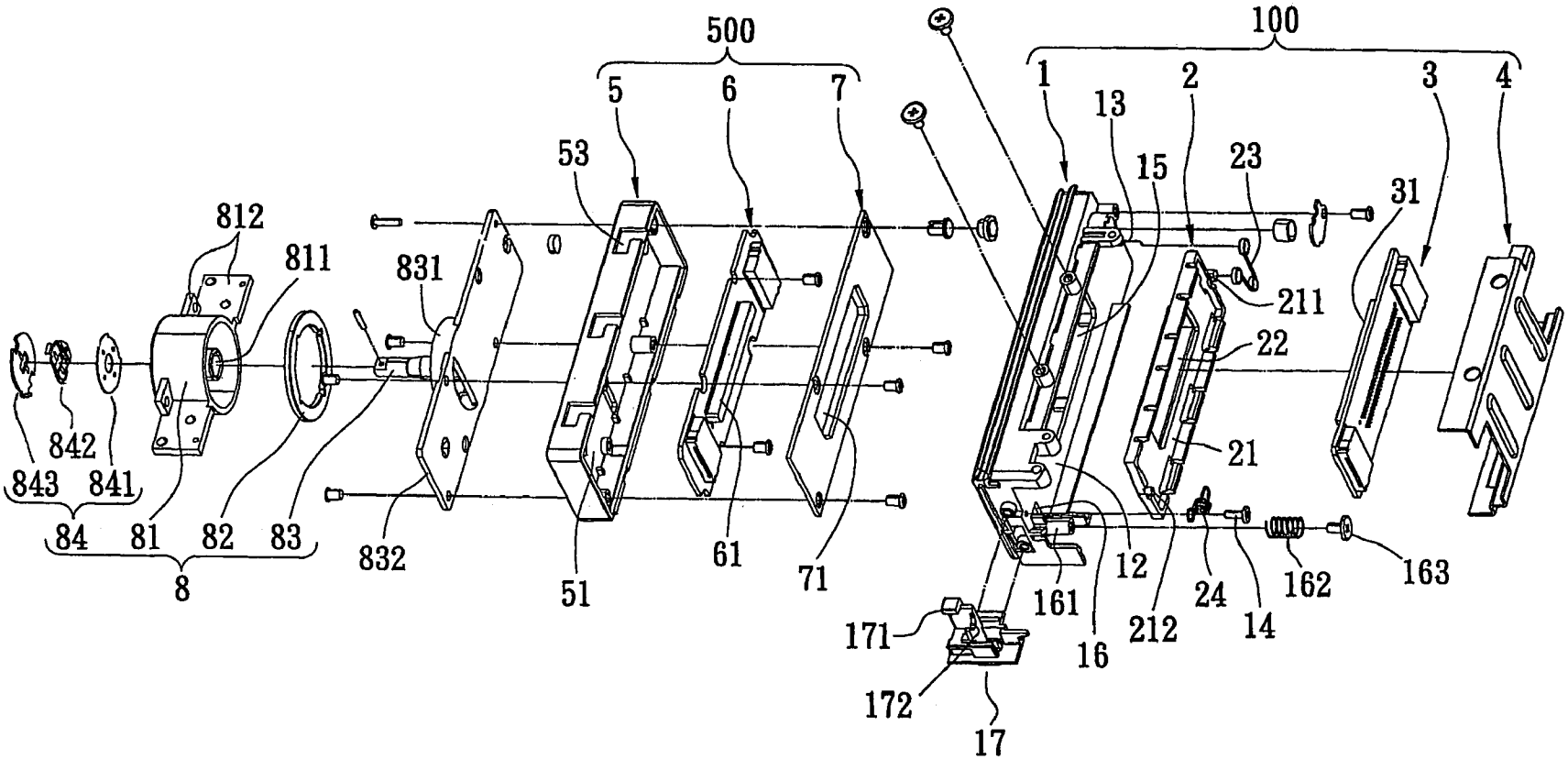
FIG. 1 shows a three-dimensional decomposition diagram of an electrical connector with a sliding connection according to the present invention.
Figure 2:
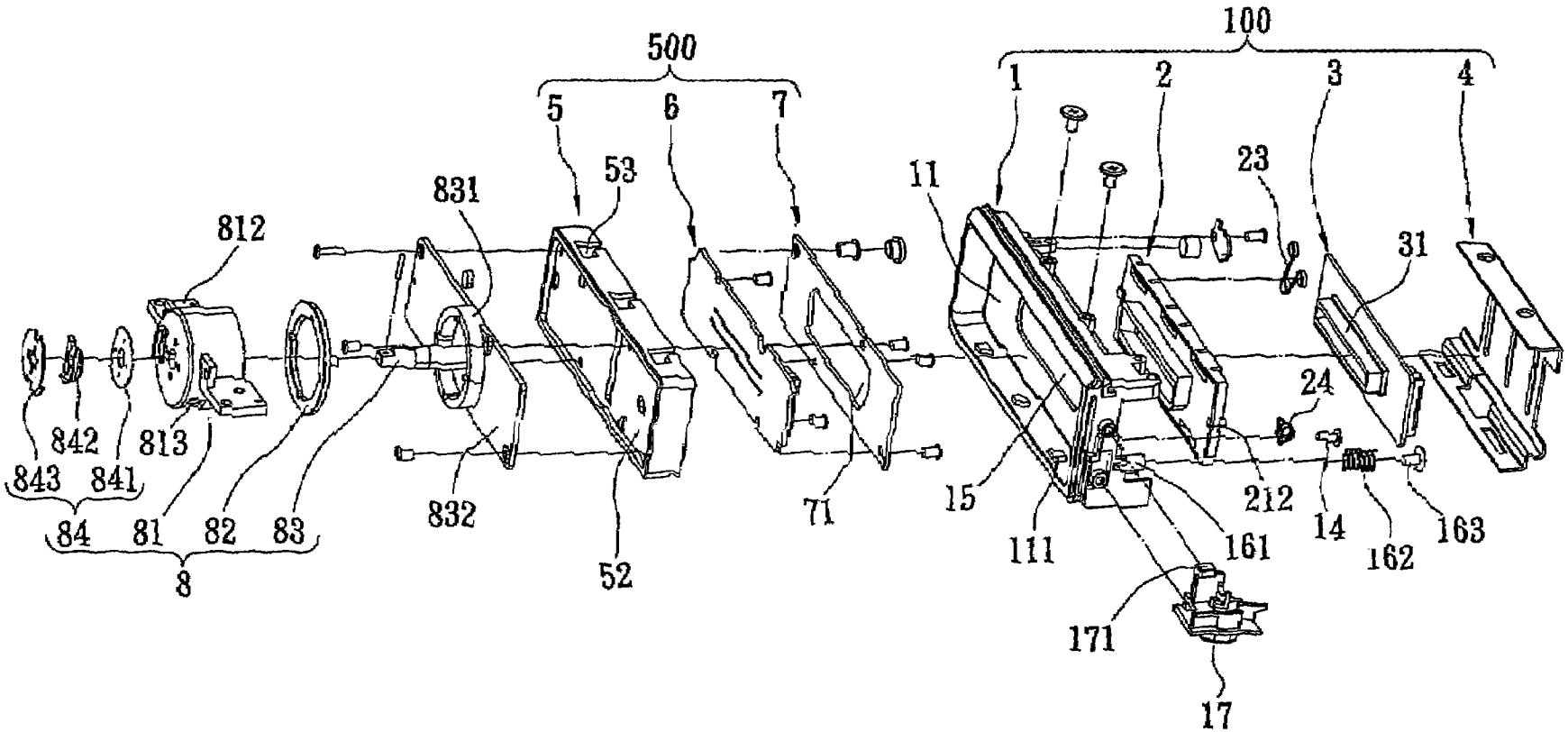
FIG. 2 shows a three-dimensional decomposition diagram of the present invention from a different angle.
Figure 3:
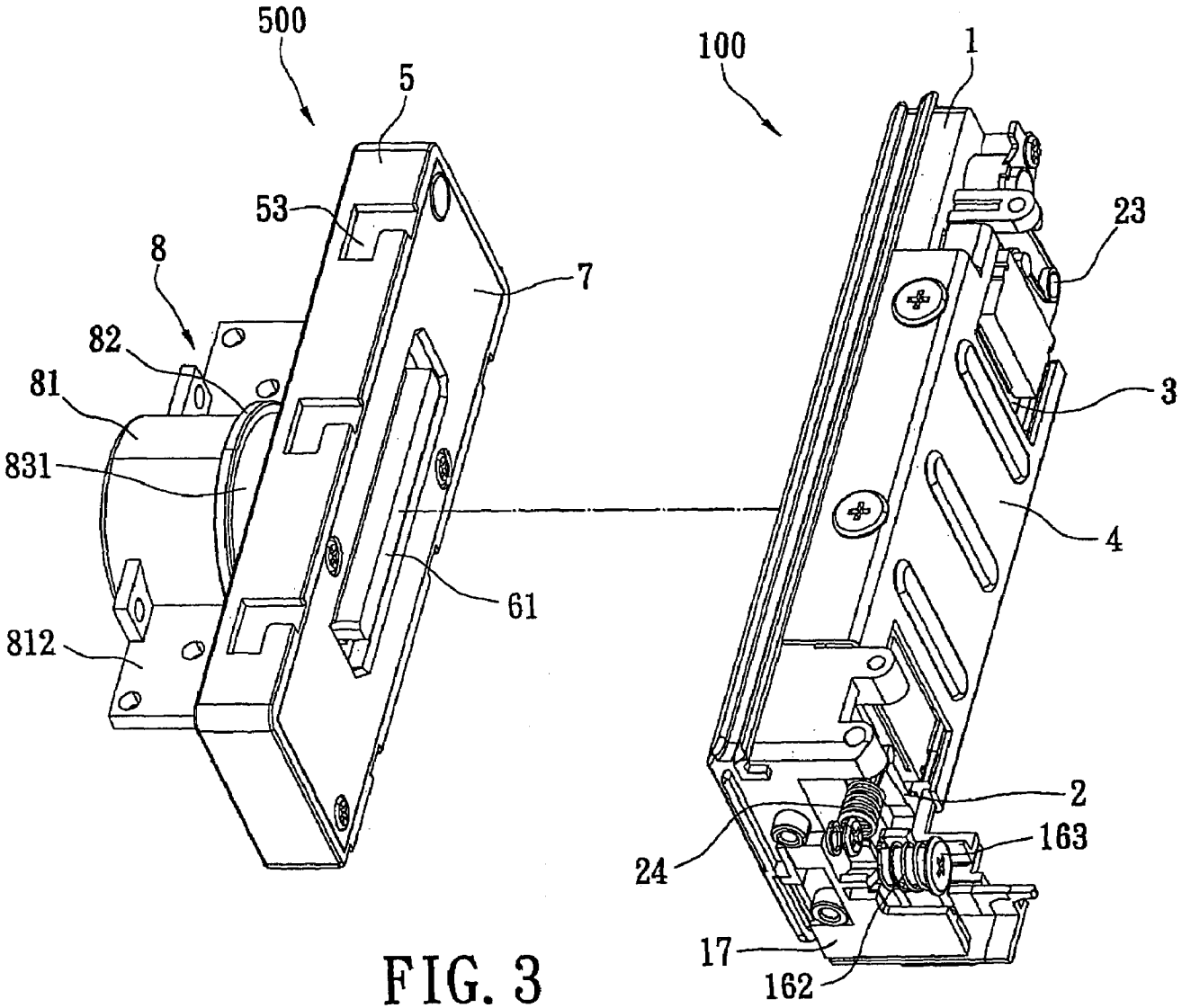
FIG. 3 shows a three-dimensional composition diagram according to FIG. 1.
Figure 4:
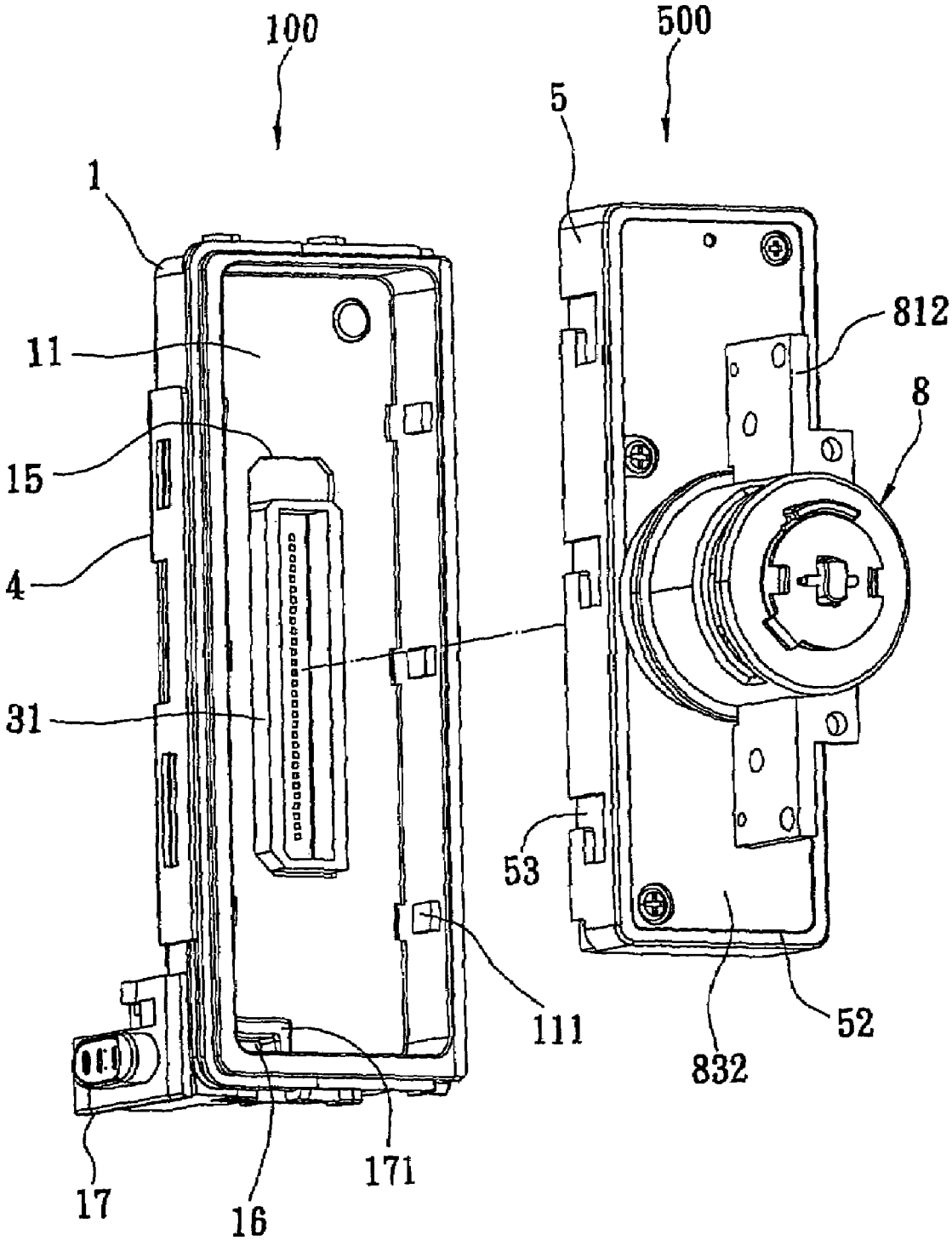
FIG. 4 shows a three-dimensional composition diagram of the present invention from a different angle.

Reference is made to FIGS. 1–7. The present invention provides an electrical connector with a sliding connection. The electrical connector comprises a main body 100 and a mated device 500. The main body 100 has a electrical connector 31 and the mated device 500 has a mated connector. The electrical connector 31 and the mated connector 61 are first connected between the main body 100 and the mated device 500, and then the main body 100 and the mated device 500 are fastened and connected by sliding motion.

The mated device 500 comprises a mated shell 5, a PCB 6 with the mated connector 61, and a cover 7 with an opening 71, which is compared to the mated connector 61. In a preferred embodiment, the mated device 500 also further has a rotational mechanism 8.

The mated shell 5 forms a capacity concave room 51 in an inner side, while an outer side of the mated shell 5 forms a orientation concave room 52. One relative flank of the periphery of the mated shell 5 has a plurality of vice-fastener 53. The PCB 6 is fixed inside the capacity concave room 51 of the mated shell 5, and the cover 7 covers the capacity concave room 51. Meanwhile, the mated connector 61 of the PCB 6 protrudes from the opening 71 of the cover 7.

The rotational mechanism 8 has a seat 81 with a penetrating hole 811 and fastening portion 812, an axle 83 with a ringlike portion 831 and a fastening portion 832, an orientation circular spacer 82 set between the seat 81 and the ringlike portion 831, and an rotational orientation module 84. The rotational orientation module 84 comprises a circular cover 841, an elastic unit 842 and a rotation stator 843. The axle 83 plugs into the penetrating hole 811 of the seat 81, then the rotational module 84 is set at the free terminal of the axle 83. Therefore, the bus will pass through each components of the rotational mechanism 8 mentioned above, and stretch out from an opening 813 of the seat 81. Due to the rotational function of the rotational mechanism 8, the bus will be protected.

The fastening portion 832 of the rotational mechanism 8 is fixed at the orientation concave room 52 of the mated shell 5. The mated device 500 and the rotational mechanism 8 are combined together, the fastening portion 812 of the seat 81 is used to fix an electrical product to allow the electrical product to rotate by the axle 83.

The main body 100 comprises a connection shell 1, a sliding seat 2 joins the connection shell 1 by sliding connection, and a PCB 3 with the electrical connector 31. The PCB 3 is oriented on the sliding seat 2. In the preferred embodiment, the main body 100 further has a back shell 4 at the backside of the connection shell 1.

The connection shell 1 forms a concave room 11 in the inner side of the connection shell. The concave room 11 is used to accommodate the mated shell 5. The outer side of the connection shell 1 forms a track 12, which is compared to the sliding seat 2. The connection shell 1 also comprises an orientation unit 13 and a pillar 161. The connection shell 1 also has an opening 15 and a slot 16; all are linked to the track 12 and the concave room 11. Inside the slot 16 is the pillar 161. The concave room 11 has a plurality of main fasteners 111 to combine the connection shell 1 with the mated shell 5. In the preferred embodiment, the main fasteners 111 can be a plurality of blocks. The vice-fastener 53 can be an L-shaped slot, so the main fasteners 111 aim the vice-fastener 53 first and then are laterally jammed together.

The pillar 161 has a third elastic unit 162. A key 17 is set between the third 162 and a plurality of blocks 163; therefore, the key 17 can have elastic displacement according to the pillar 161. The key 17 further has a stop portion 171 and a dent 172. The key 17 can stretch into the concave room 11 through the slot 16 by elasticity. The half-arc dent 172 contacts the pillar 161 so as to support the blocks 163 and the dent 172 to provide a displacement function.

The sliding seat 2 has an inner side, which has an orientation concave room 21. The orientation concave room 21 has an opening 22. A plurality of orientation units 211, 212 is set on one side of the sliding seat 2. Therefore, the PCB 3 is fixed inside the orientation concave room 21. The electrical connector 31 of the PCB 3 protrudes from the opening 22. The sliding seat 2 joins the track 12 of the connection shell to allow the electrical connector 31 to stretch more deeply into the concave room 11.

A first elastic unit 23 is located between the orientation unit 211 and the orientation unit 13 of the connection shell 1 for elastic support. A second elastic unit 24 is located between the orientation unit 212 and the orientation unit 14 of the connection shell 1 for elastic support. The two elastic units 23, 24 are used to push or pull elastically the sliding seat 2. In another words, the sliding seat 2 has elastic displacement in the track 12 due to external forces, as does the electrical connector 31.

The back shell 4 covers the track 12 of the connection shell 1 to shelter the PCB 3. The components mentioned above constitute the present invention of electrical connector with sliding connection.

The main body 100 first connects the mated device 500 to make the mated shell 5 into the concave room 11 of the connection shell 1. The electrical connector 31 and the mated connector 61 electrically connect. Each main fastener 111 is put into the lateral portion of the vice-fastener 53, and the stop portion 171 of the key 17.

Clamping the connection shell 1 and the mated shell 5 vertically can make the main fastener 111 move to the vertical portion of the vice-fastener 53. Therefore, as shows in FIG. 6, there is a small distance between the mated shell 5 and the connection shell 1. The stop portion 171 of the key 17 can stretch into the concave room 11 to stop the mated shell 5 from sliding.

When the connection shell 1 and the mated shell 5 are vertically clamped, the electrical connector 31 will follow the motion of the sliding seat 2 to ensure that the electrical connector 31 electrically contacts the mated connector 61. The mated connector 61 thus promotes elastic sliding of the electrical connector 31 and the sliding seat 2.

The first and second elastic units 23, 24 accumulate an elastic restoration force at the same time to push the mated shell 5 back to the original position thereof. Meanwhile, user can separate the main body 100 and the mated device 500 transversely.

Figure 5:
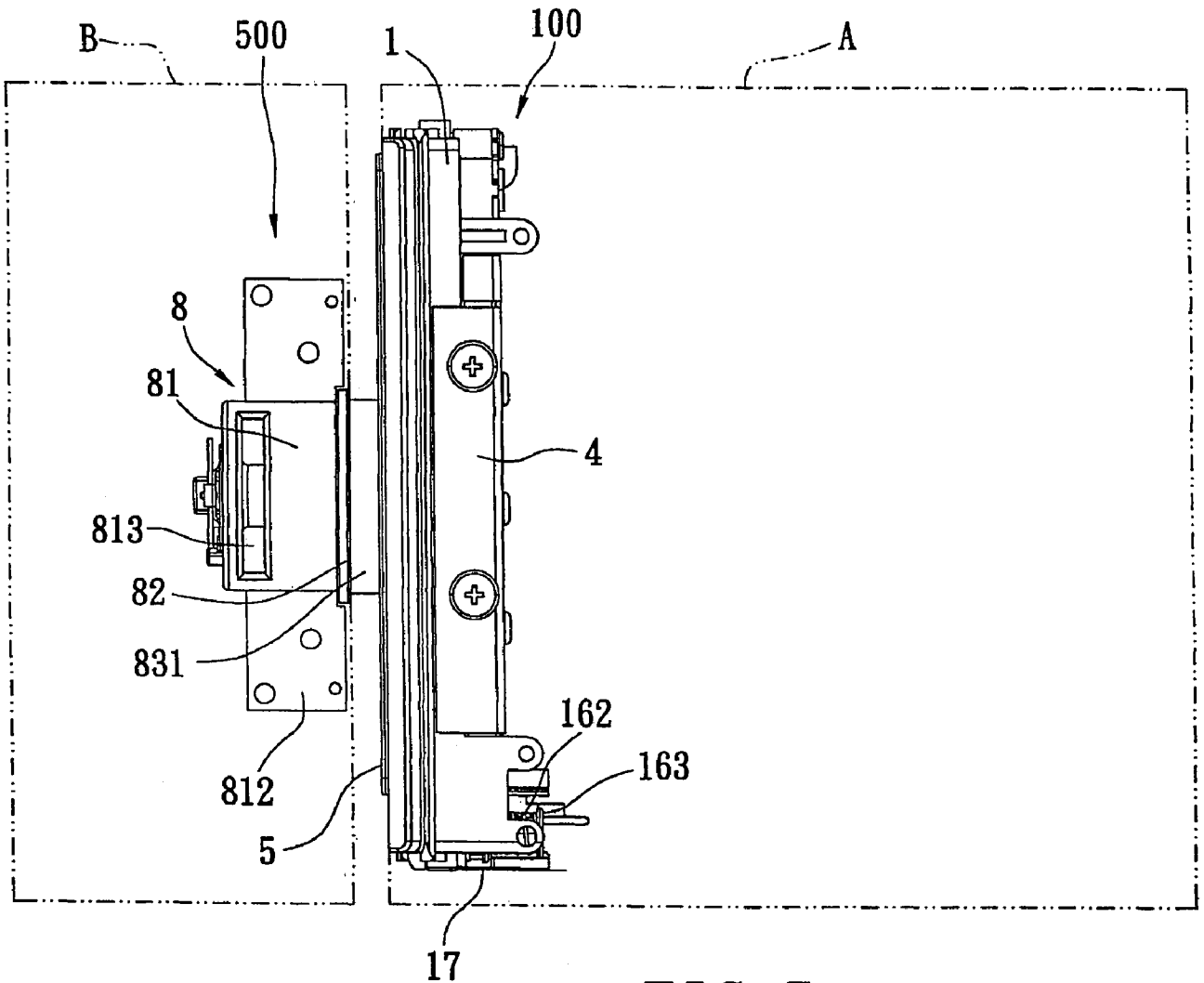
FIG. 5 shows a front view diagram of the present invention after assembly, and embodiment diagram.
Figure 7:
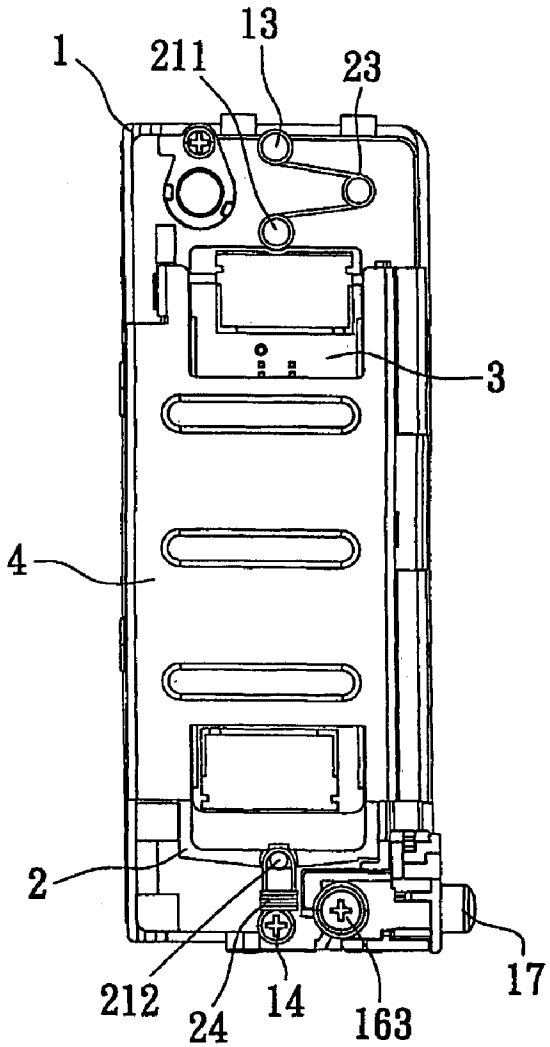
FIG. 7 shows a right side view diagram of the present invention according to FIG. 5.
Figure 6:
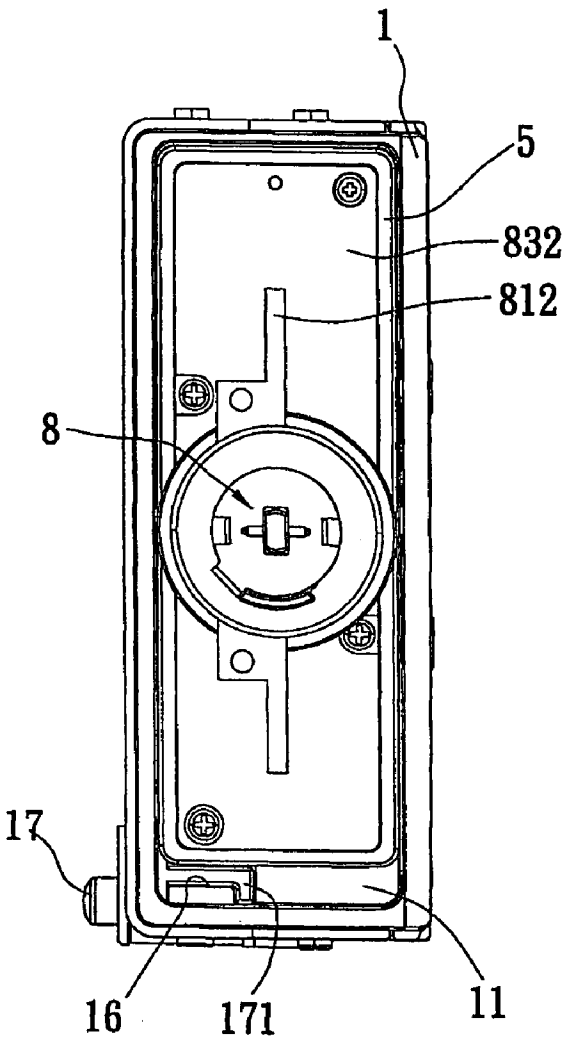
FIG. 6 shows a left side view diagram of the present invention according to FIG. 5.

FIG. 5 shows the main body 100 of the present invention fixed on an first electrical product A. The mated device 500 can be fixed on a second electrical product B by the fastening portion 812 of the rotational mechanism 8. Therefore, the two electrical products A, B can electrically and mechanically connect to each other via the main body 100 and the mated device 500. The second electrical product B also can rotate around the axle 83 by the rotational mechanism 8.

The structure of the present invention connects the electrical connector 31 and the main body 100, and a mated connector 81 is set on a mated device 500, in which the main body 100 has a sliding function. The present invention can electrically connect the electrical connector 31 and the mated connector 61, and the main body 100 and the mated device 500 can be combined together mechanically by a sliding function.

Even if each connector has many signal wires, the present invention still can combine two electrical products by a sliding function. Users can easily and quickly take apart or combine any second electrical product B. The second electrical product B becomes an application module of the first electrical product A. Further, the present invention sets the rotational mechanism 8 on the mated device 500 to fix an electrical product on another side of the rotational mechanism 8.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. An electrical connector with sliding connection, comprising:

a main body and a mated device coupled each to the other in opposite positions, the mated device including a mated shell having a mated connector and a plurality of vice-fasteners, the main body including a connection shell, a seat and a PCB, said connection shell having a concave recess formed on an inner side thereof, the concave recess having a plurality of main fasteners matching the vice-fasteners, the connection shell having an opening between the inner side and an outer side thereof, wherein the mated shell first connects with the concave recess and then clamps the main fasteners and the vice-fasteners by a sliding motion;

said seat being coupled to the outer side of the connection shell and having a first and a second elastic unit slidably positioned between the seat and the connection shell, the seat being slidably displaceable on the outer side of the connection shell;

the PCB being set on the seat and having an electrical connector, the electrical connector plugging into the concave recess through the opening of the connection shell, wherein the electrical connector protrudes through the opening.

2. The electrical connector with sliding connection as recited in claim 1, wherein the outer side of the connection shell of the main body includes a track, said track connected to said concave recess through said opening in said connection shell and the seat being slidably displaceably on the track.

3. The electrical connector with sliding connection as recited in claim 1, wherein the main body includes a key, the key being positioned between the outer side of the connection shell and the concave recess, wherein the key stops the connection shell from sliding into the concave recess.

4. The electrical connector with sliding connection as recited in claim 3, the key of the main body includes a stop portion, the stop portion protrudes into the concave recess thereby preventing said connection shell from sliding into the concave recess.

5. The electrical connector with sliding connection as recited in claim 1, wherein the main fasteners are blocks and a corresponding position of the mated shell of the mated device having a plurality of curved-shape slots, wherein the blocks latch with the curved-shaped slots.

6. The electrical connector with sliding connection as recited in claim 1, wherein the mated device includes a PCB with the mated connector, an inner side of the mated shell having a capacity concave recess, wherein the PCB is positioned inside the capacity concave recess.

7. The electrical connector with sliding connection as recited in claim 6, wherein the mated device includes a cover having an opening, wherein the cover covers the capacity concave recess, and the opening of the cover facing the mated connector thereby exposing the mated connector.

8. The electrical connector with sliding connection as recited in claim 1, wherein the mated device includes a rotational mechanism, the rotational mechanism having a rotational orientation function, one terminal of the rotational mechanism being fixed on the mated shell, and a second terminal being adapted to be coupled to another component.

9. The electrical connector with sliding connection as recited in claim 8, wherein the rotational mechanism of the mated device includes a seat with a penetrating hole;

an axle being inserted into said penetrating hole and being rotatable, the seat and the axle each respectively having a connection portion and a fastening portion, the fastening portion of the axle is fixed on the inner side of the mated shell, and the connection portion of the seat being adapted to be coupled to another component.

10. An electrical connector with a sliding connection, comprising:

a connection shell including a concave recess, the concave recess being positioned on an inner side of the connection shell and having a plurality of main fasteners, the concave recess having an opening on an outer side of the connection shell;

a seat, said seat slidably coupled to the outer side of the connection shell, wherein the seat has a first and a second elastic unit positioned between the connection shell and the seat, the seat being slidably displaceable on the outer side of the connection shell; and a PCB having an electrical connector, wherein the PCB board is set on the seat, the electrical connector being inserted into the concave recess through the opening of the connection shell, the electrical connector protruding through the opening.

* * * * *